United States Patent [19]

Dutka

[11] Patent Number: 4,918,877

[45] Date of Patent: Apr. 24, 1990

[54] INFLATABLE TUBULAR STRUCTURE

[76] Inventor: Walter J. Dutka, 4468 Seneca St., West Seneca, N.Y. 14224

[21] Appl. No.: 281,076

[22] Filed: Dec. 8, 1988

[51] Int. Cl.[5] ..... E04G 11/04; E04B 1/345

[52] U.S. Cl. ..... 52/2 J; 285/24; 285/423

[58] Field of Search ..... 52/2 J, 2 K, 2 R; 285/423

[56] References Cited

U.S. PATENT DOCUMENTS 547,119 10/1895 Heaton et al. ..... 52/2 K
2,591,829 4/1952 Katzenmayer et al. ..... 52/2 K
4,597,594 7/1986 Kacalieff et al. ..... 285/423
4,635,972 1/1987 Lyall ..... 285/423
4,648,628 3/1987 Meadows et al. ..... 285/423

*Primary Examiner*—James L. Ridgill, Jr.
*Attorney, Agent, or Firm*—Richard C. Litman

[57] ABSTRACT

A multi-ply tubular inflatable support beam structure that can readily be disassembled to become portable. When inflated the beams are covered with a fabric cover. The tubular beams are sealed on both ends mechanically with a hard plastic device by a sealant, and then clamped. A valve located at one end of the tube permits attachment of an air hose in order to inflate the tubular beams.

4 Claims, 4 Drawing Sheets

Fig. 10
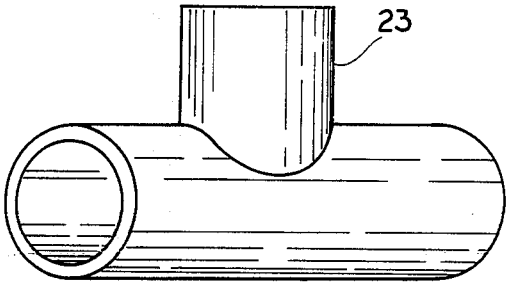
Fig. 11
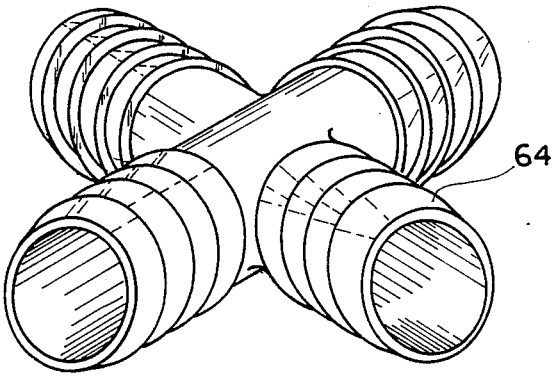
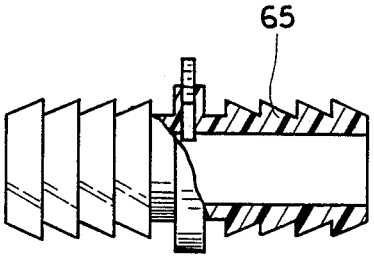
Fig. 12

INFLATABLE TUBULAR STRUCTURE

BACKGROUND OF THE INVENTION

This invention relates generally to a multi-ply rubber hose structure that is readily inflatable and deflatable and lends itself to various skeletal configurations.

The formation of a skeletal support structure usually entails weighty scaffolding of performed rigidity. The use of a sealed end on an inflatable multi-ply tubular flexible structure provides a structural skeletal basis that lends itself to an extended utility, to enable the support of tents or canopies of alternate configurations.

Several devices have been suggested in the past involving air-supported elements as a functional skeletal component U.S. Pat. No. 3,059,657 issued Oct. 23, 1962 to Turner discloses an air supported building supported by air pressure within the ; building wherein elongated members which are rigid and noninflatable, are inserted in a hem formed at the edge of the building. U.S. Pat. No. 3,840,919 issued Oct. 15, 1974 to Middleton discloses an inflated tent with hollow ribs having a one-way removable valve.

These patents or known prior uses teach and disclose various types of inflatable structures of sorts and of various manufactures, and the like, as Well as methods of their construction; but none of them, whether taken singly or in combination, disclose the specific details of the combination of the invention in such a Way as to bear upon the claims of the present invention.

SUMMARY OF THE INVENTION

By the present invention an improved freestanding, shaped, portable, self-supporting inflatable tubular beam framework structure is provided which is sealed and flexible and able to be fashioned into a finished shape at the discretion of the user. The framework is formed by a plurality of individual inflatable tubes, each of which is sealed at both ends and has an air valve in one end. Plastic tees are positioned on each beam and serve as connectors to other beams. The device is portable when deflated and it is easily stored.

More specifically, the structure generally comprises a plurality of flexible air inflatable tubes which are attached in a manner to form various shapes, when inflated. The tubes are connected to hollow T-shaped connecting devices and contain an air inlet means at one end of the connected tubes for introducing air under pressure; the other end of each tube is sealed. The structure also includes stabilizer straps and a cover.

Accordingly, one of the objects of the present invention is to provide an improved multi-ply inflatable tubular beam structure sealed on one the end.

Yet another object, advantage and feature of the invention is to provide a novel and improved construction of an inflatable support structure, to wit, the employment of support straps to retain the arcuate inflatable support members in the desired configuration.

A further object of the present invention is to provide an air medium in a sealed support structure with spaced tees as an essential element of the assembly, Still another object of the present invention is to provide an assembly of components that may be deflated and compacted to render the assemblage portable.

With these and other objects in view, Which will more readily appear as the nature of the invention is better understood, the invention resides in the novel construction, combination and arrangement of parts hereinafter more fully illustrated, described and claimed, with reference being made to the accompanying drawings.

BRIEF DESCRIPTION OF THE DRAWINGS

FIG. 10 is a perspective view of a T-shaped hollow connector.

FIG. 11 is a perspective view of a four-way hollow connector.

FIG. 12 is a cutaway section view of a fitting on the hemispherical-shaped structure with an air valve for inflating a tube.

Similar reference characters designate corresponding parts throughout the several Figures of the drawings.

DESCRIPTION OF THE PREFERRED EMBODIMENT

Figure 2:
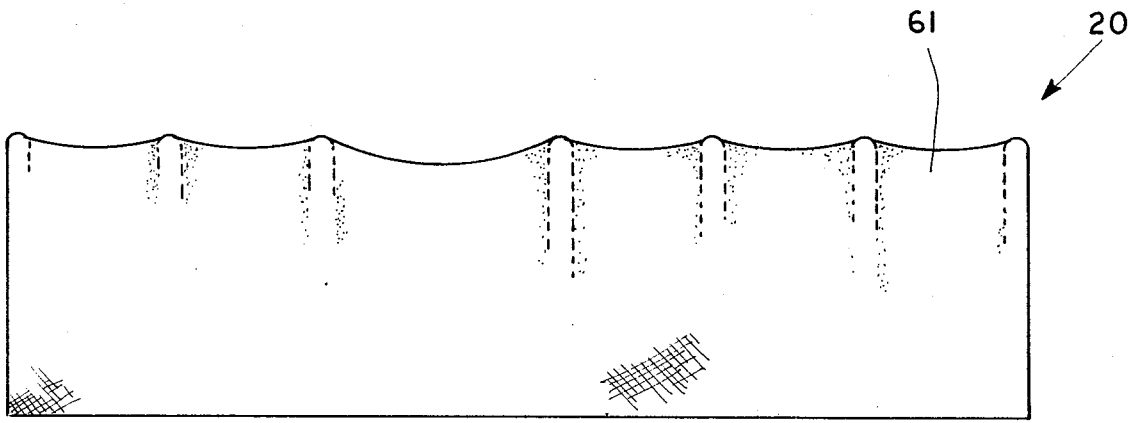
FIG. 2 is an elevation view of a second embodiment of the invention, showing an inflatable semicylindrical-shaped structure, comprising a plurality of sealed and inflated tubes, with a cover attached thereon.
Figures 3, 4, 5, 6:
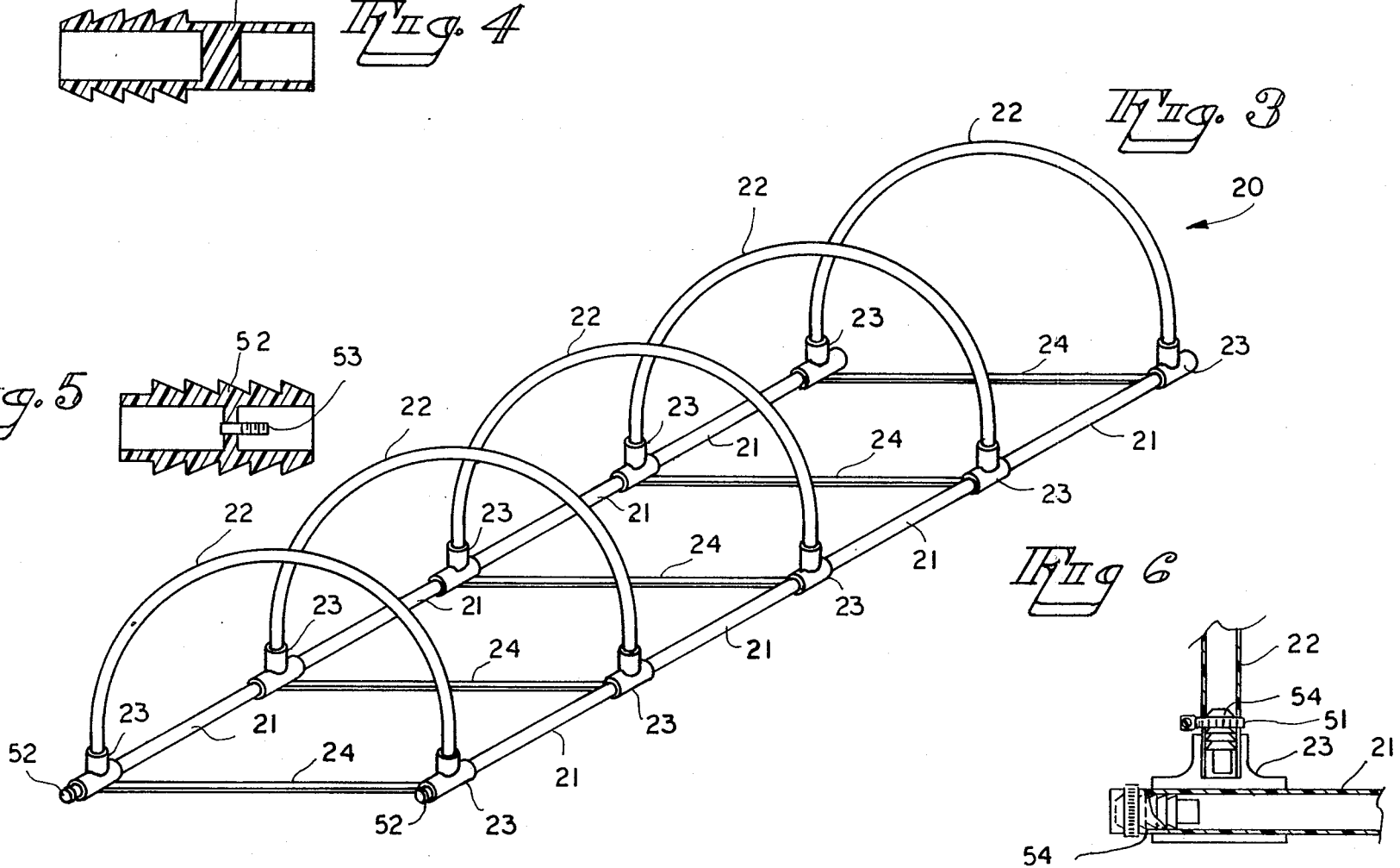
FIG. 3 is a perspective view of an inflatable semicylindrical-shaped structure, comprising a plurality of sealed and inflated tubes connected by hollow connectors.
FIG. 4 is a detail section view of a fitting which provides an airtight seal at the end of an inflatable tube and connects an inflatable tube to a hollow connector.
FIG. 5 is a detail section view of a fitting which provides an airtight seal at the other end of an inflatable tube, and which also includes an air valve for inflating the tubes and connects an inflatable tube to a hollow connector.
FIG. 6 is a sectional view of a hollow tee connector as found of the parallel structures of FIG. 3, showing inflatable tubes installed at the tee connector.

FIGS. 2 and 3 show one embodiment of the present invention, wherein a plurality of inflatable tubes 21, 22 are passed through or attached to hollow connectors 23 to form a generally semicylindrical framework 20. The two parallel inflatable bass tubes 21 pass through hollow three-way connectors 23, to form the parallel base tubes 21. The distance between the parallel base tubes 21 is restricted by the stabilizer straps 24 connected at each end to a three-way hollow connector 23. A second set of inflatable tubes 22 are attached at each of their ends to opposing three-way hollow connectors 23, so that the second set of tubes 22 are bento into an arch.

Together, as shown in FIG. 3, the second tubes 22 form a structure which forms an arched support over the area delimited by the parallel base tubes 21. The entire framework is formed by a plurality of these inflatable tubes, each tube forming a single air passage. Each tube is independently inflatable by means of an inflation valve on one end of the tube.

At each outer end of the inflatable base tues 21 is a seal plug 54, as shown in FIG. 3. Each of the inflatable base tubes 21 is easily inflated at the other end by means of a seal plug 52 which has a conventional air inflation valve 53 thereon. The seal plug 52 with air inflation valve 53 is shown in FIG. 5. Each of the arched tubes 22 in FIG. 3 also has a seal plug 52 at one end and a seal plug 54 at the other end.

Figure 7:
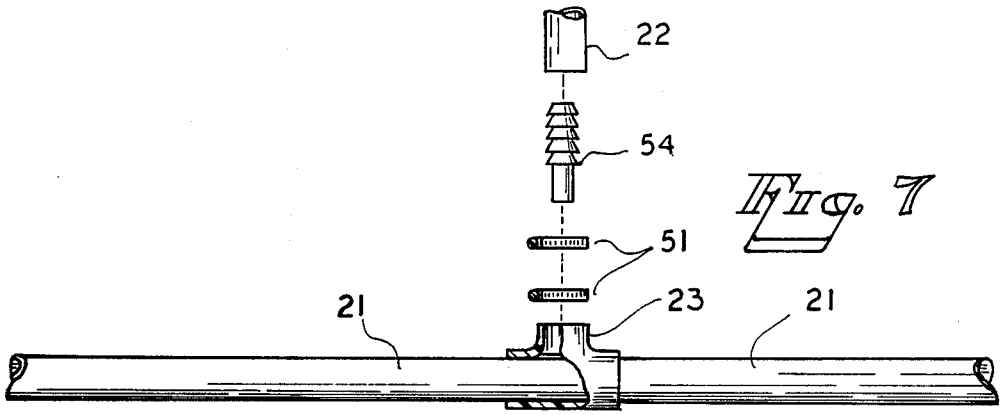
FIG. 7 is an exploded view of an inflatable tube passing through a hollow connector and a fitting for attaching the end of a sealed, inflatable the tube to the connector.

FIGS. 6 and 7 show the fittings used to attach the inflatable tubes to a three way fitting 23. Secondary, arched tube 22 is attached to the connector 23 by means of a tubular fitting 52 as shown in FIG. 6. Fitting 54, as shown in FIG. 4, may be provided with serrations as shown to grip the inner wall of tube 22. The base tubes 21 pass through the hollow three way connectors 23 as shown. Clamps 51 provide extra strength in sealing the hose 21 and 22 to the fittings 52 and 54.

The hemispherical framework 20 may be covered by a fabric, mesh or other suitable flexible covering 61, to form an enclosure face shown in FIG. 2. The covering 61 may be secured to the arched tubes 22 by any suitable releasable securing means, such as straps having snaps or a hook-andloop fastener, on the inside surface of the covering 61. A doorway flap 63 is provided on both ends of the structure.

Figure 8:
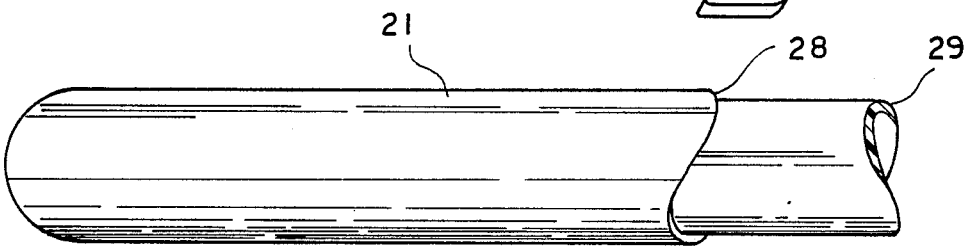
FIG. 8 is a cutaway view of the preferred construction of an inflatable tube for use with the invention.

FIG. 8 shows the preferred construction of the inflatable tubes 21 and 22. The tubes have an inner rubber layer 29 surrounded by an single ply woven polyester outer jacet 28.

Figure 1:
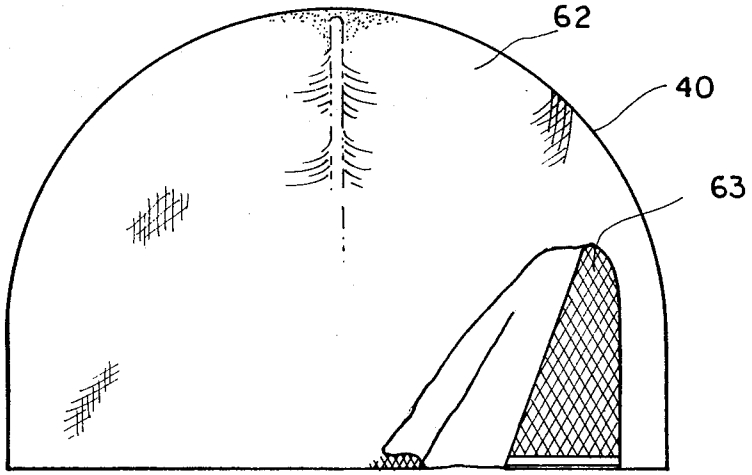
FIG. 1 is an elevation view of one embodiment of the invention, showing an inflatable dome-shaped structure, comprising a plurality of sealed and inflated tubes, with a covering attached thereon.
Figure 9:
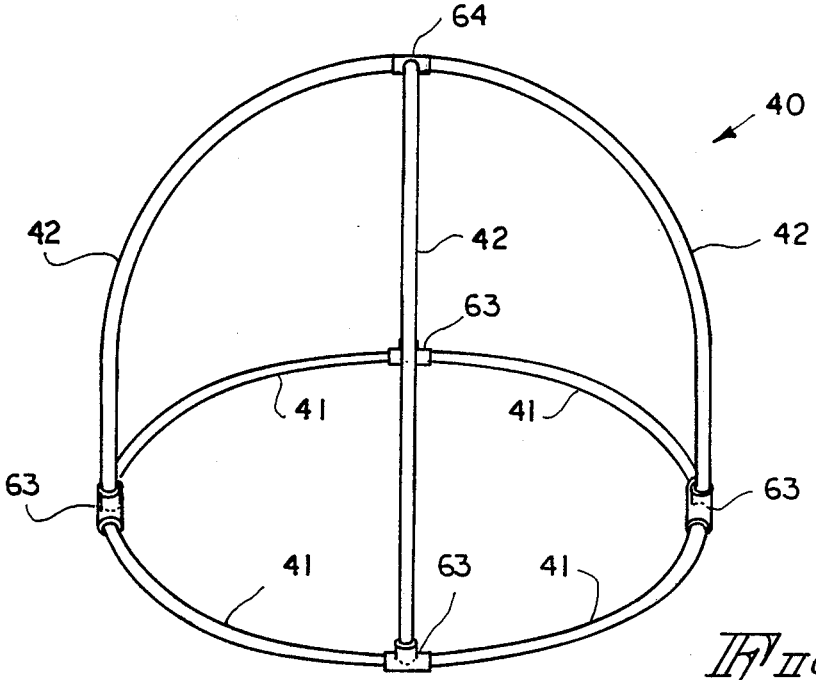
FIG. 9 is a perspective view of an inflatable hemispherical-shaped structure comprising a plurality of sealed, inflated tubes connected by hollow connectors.

FIGS. 1 and 9 show a second embodiment of the invention wherein a plurality of inflatable tubes 41, 42 are attached by hollow connectors 63, 64 to form a generally hemispherical shaped framework 40. A single base tube 41 passes through three-way connectors 63 to form a horizontal ring. The base tube 41 is connected by a fitting 65 shown in FIG. 12, which includes an air valve 66. The three-way connectors 63, as shown in FIGS. 9, are similar to the connectors 23 used in the first embodiment. An arched tube 42 is attached to each three-way connector 63, and curves upward to a four-way connector 64, which connects all four tubes 42. The four-way connector 64 may have serrations as shown in FIG. 11 to grip the inside wall of the arched tubes 42. Together, the arched tubes 42 form a hemispherical framework. Each end of the arched tube 42 is sealed by use of a fitting with an air valve at one end FIG. 5 and a seal plug at the other end FIG. 4.

The second embodiment may also be provided with a fabric or mesh cover 62 as shown in FIG. 2. The cover may be attached by any suitable attaching means as described above. The cover 62 may further be provided with a doorway flap 63 as shown.

The invention provides a structure which is easily assembled and inflated. When deflated, the structure is compact for storage or travel.

The foregoing is considered as illustrative only of the principles of the invention. Further, since numerous modifications and changes will readily occur to those skilled in the art it is not desired to limit the invention to the exact construction and operation shown and described and accordingly all suitably modifications, and equivalents which may be resorted to fall within the scope of the invention.

I claim:

1. A free-standing semi-cylindrical shaped, self-supporting, flexible framework structure, including:

a plurality of hollow connectors having a central passageway and a secondary passageway leading into said central passageway and normal to said central passageway, said plurality of hollow connectors disposed in two horizontal parallel rows;

two parallel horizontal air inflatable tubes having opposite ends disposed through the central passageways of said hollow connectors;

a plurality of secondary tubes having opposite ends, each end of each said secondary tube is disposed in the secondary passageway of one of said hollow connectors on each said horizontal tube, thereby giving an archer framework between the parallel horizontal tubes;

an air inlet means comprising a ridged plug having a hollow air tube disposed therethrough disposed at one of said ends for each of said horizontal and secondary tubes and a seal means comprising a ridged plug disposed in the other said end for each of said horizontal and secondary tubes;

a plurality of horizontal stabilizer straps, the ends of said straps attached to opposing connectors on said horizontal tubes.

2. The structure according to claim 1, including:

a fabric covering mountable over said framework structure to provide a full enclosure therewithin; and means for removably attaching said cover to said framework structure.

3. A free standing, hemispherical-shaped self-supporting, flexible framework structure, including:

a plurality of hollow first connectors having a central passageway and a secondary passageway leading into said central passageway and disposed normal to said central passageway;

a first flexible air inflatable tube, said first tube disposed through said central passageways of said connectors, said first tube having the shape of a continuous ring with opposite ends connected by a second hollow connector comprising a hollow passageway with external ridges at each end, said opposite ends of said first tube disposed over said opposite ends of said second connector;

an air inlet tube disposed through said second hollow connector and feeding into said passageway;

four secondary flexible air inflatable tubes having opposite ends, one end of each said secondary tubes disposed through said secondary passageway of each said first connectors, the other ends of said secondary tubes attached to a third hollow connector disposed above said first tube and having four branched passageways having external ridges, each said other end disposed over each branched passageway, thus giving a dome shaped framework;

a sealing means comprising a ridged plug disposed in said one end of said secondary tubes, at least one of said sealing means having an air inlet tube disposed therethrough;

a plurality of horizontal stabilizer straps, the ends of said straps attached to opposing hollow connectors;

said framework being deflatable and separable.

4. The structure according to claim 3, including:

a fabric cover mountable over said framework structure to provide a full enclosure therewithin;

means for removably attaching said cover to said framework structure.

* * * * *